US010670339B2

(12) United States Patent
Tockert et al.

(10) Patent No.: US 10,670,339 B2
(45) Date of Patent: Jun. 2, 2020

(54) DEVICE FOR COOLING A SHAFT FURNACE DISTRIBUTION CHUTE SUPPORT JOURNALS

(71) Applicant: Paul Wurth S.A., Luxembourg (LU)

(72) Inventors: Paul Tockert, Berbourg (LU); Harald Lang, Trier (DE)

(73) Assignee: PAUL WORTH S.A., Luxembourg (LU)

( * ) Notice: Subject to any disclaimer, the term of this patent is extended or adjusted under 35 U.S.C. 154(b) by 0 days.

(21) Appl. No.: 15/521,491

(22) PCT Filed: Oct. 21, 2015

(86) PCT No.: PCT/EP2015/074302

§ 371 (c)(1),
(2) Date: Apr. 24, 2017

(87) PCT Pub. No.: WO2016/062740

PCT Pub. Date: Apr. 28, 2016

(65) Prior Publication Data

US 2017/0307293 A1 Oct. 26, 2017

(30) Foreign Application Priority Data

Oct. 22, 2014 (LU) ..... 92581

(51) Int. Cl.
*F27B 1/24* (2006.01)
*C21B 7/20* (2006.01)
(Continued)

(52) U.S. Cl.
CPC ..... *F27B 1/24* (2013.01); *C21B 7/10* (2013.01); *C21B 7/20* (2013.01); *F27B 1/20* (2013.01)

(58) Field of Classification Search
CPC ..... C21B 7/20; C21B 7/10; F27B 1/24; F27B 1/20
(Continued)

(56) References Cited

U.S. PATENT DOCUMENTS 2,346,805 A * 4/1944 Whiteley ..... F16C 37/00 384/317
3,233,757 A * 2/1966 Long ..... B65D 90/582 414/200

(Continued)

FOREIGN PATENT DOCUMENTS

DE 4216166 A1 12/1992
EP 2808406 A1 * 12/2014 ..... C21B 7/20
WO 2013107078 A1 7/2013

OTHER PUBLICATIONS

Written Opinion dated Dec. 17, 2015 re: Application No. PCT/EP2015/074302; pp. 1-4; citing: DE 42 16 166 A1 and WO 2013/107078 A1.

(Continued)

*Primary Examiner* — Steven B McAllister
*Assistant Examiner* — John E Bargero
(74) *Attorney, Agent, or Firm* — Cantor Colburn LLP

(57) ABSTRACT

A device for cooling the supporting trunnions of a distribution spout of a charging installation of a shaft furnace, wherein the spout is mounted pivotably about a horizontal axis on a shell coaxial with the furnace and the spout is attached rotatably to the trunnions driven in rotation by a drive component. The trunnions are directly attached for rotation by their ends to output shafts of reduction gears and include internal cooling channels. The cooling device includes feed and return ducts for the cooling water circulating in the internal channels. The feed and return ducts are connected to the trunnions by connectors fixed to the cylindrical surface of the trunnions. The feed and return ducts are (Continued)

arranged to permit rotational displacement of the connectors about the pivot axis of the spout during pivoting of the spout, in particular by passing through oblong slots extending circumferentially in the wall of bearings supporting the driving reduction gears.

11 Claims, 1 Drawing Sheet

(51) Int. Cl.
*F27B 1/20* (2006.01)
*C21B 7/10* (2006.01)
(58) Field of Classification Search
USPC ..... 432/235; 266/135
See application file for complete search history.

(56) References Cited

U.S. PATENT DOCUMENTS 3,975,578 A * 8/1976 Greenewald, Jr. ..... F27D 11/08
373/62
2006/0162540 A1* 7/2006 Meintjes ..... F16C 23/06
89/37.07

OTHER PUBLICATIONS

International Search Report dated Dec. 17, 2015 re: Application No. PCT/EP2015/074302; pp. 1-2; citing: DE 42 16 166 A1 and WO 2013/107078 A1.

* cited by examiner

DEVICE FOR COOLING A SHAFT FURNACE DISTRIBUTION CHUTE SUPPORT JOURNALS

FIELD OF THE INVENTION

The present invention relates to a device for cooling the supporting trunnions of a distribution spout of a charging installation for a shaft furnace such as a blast furnace.

BACKGROUND OF THE INVENTION

Such an installation typically comprises a stationary feed channel arranged vertically in the centre of the furnace throat, centred on the vertical axis of the furnace, and a distribution spout for distributing the charged materials arriving via said channel in the furnace. In order to enable appropriate distribution of the charged material, the distribution spout may be rotated about said vertical axis and pivoted about a horizontal axis. To this end, the spout is typically mounted pivotably about said horizontal axis, in a shell mounted coaxially around said feed channel, and rotatably about the vertical axis. The spout is mounted pivotably in the shell by means of trunnions of a generally cylindrical shape with a horizontal axis, to which the spout is secured and which are mounted revolvably about said horizontal axis in bearings integral with the shell. In general, the shell is rotated and the spout pivoted by gear means located in an annular chamber surrounding the shell.

The spout is fixed on either side on radially inner ends, directed towards the vertical axis of the furnace, of the trunnions, which are driven pivotably by means of geared drive means located in said chamber surrounding the shell. Said drive means may act directly on the trunnions by meshing, or by means of arms or levers.

The trunnions therefore have an inner end part which is located inside the shell and is therefore directly exposed to the intense heat prevailing in the shaft furnace. They furthermore receive heat conducted from the spout which is itself entirely exposed to the heat of the furnace. In order to cool the trunnions, and optionally the spout, it is known to circulate cooling water in channels provided in the trunnions, the cooling water being introduced into the trunnions via their outer frontal ends opposite the inner ends to which the spout is fixed. In general, because the trunnions are rotatable, revolving joints mounted axially on the outer frontal ends of the trunnions are used to provide a connection between the channels inside the trunnions and the cooling water feed circuit, stationary on the shell, as in particular shown in DE4216166.

A drive system has recently been developed for pivoting the spout which makes use of epicyclic reduction gears which are directly attached to the outer frontal ends of the trunnions. In practice, the trunnions are directly attached to the output shaft of the reduction gears. As a consequence, the frontal end faces of the trunnions are no longer accessible and therefore the cooling circuit can no longer be connected to the trunnion cooling channels as in the prior art via revolving joints fixed to said outer frontal ends.

SUMMARY OF THE INVENTION

The invention provides proper cooling of the trunnions, and optionally of the spout, when it is not desired or is impossible to connect the water feed circuits to the outer end of the trunnions. More generally, the invention proposes a novel system which makes it possible to feed and return cooling water to/from the trunnions and to dispense with the revolving joints which are conventionally used.

Thus, the invention provides a cooling device for the supporting trunnions of a distribution spout of a charging installation for a shaft furnace, such as a blast furnace, the spout being mounted pivotably about a horizontal axis on a shell coaxial with the furnace and the spout being attached rotatably to the trunnions driven in rotation by drive means, the trunnions comprising internal cooling channels. According to the invention, the cooling device comprises feed and return ducts for the cooling water circulating in the internal channels, the feed and return ducts being connected to the trunnions by connectors fixed to the cylindrical surface of the trunnions, and the feed and return ducts are arranged to permit rotational displacement of the connectors about the pivot axis of the spout (i.e. about the axis of rotation of the trunnions) during pivoting of the spout.

Connection of the cooling ducts to the periphery of the trunnions therefore makes it possible to supply cooling water to the internal channels of the trunnions from the outer cylindrical surface of the trunnions, instead of providing said connection via the outer frontal face, which may therefore in particular be connected directly to the rotational drive means.

Preferably, the feed and return ducts are flexible ducts connected directly to the trunnions by screwed connectors, but could also be made up of rigid tubes attached with revolving connectors.

According to one particular arrangement, the trunnions are mounted revolvably inside bearings integral with the shell and the feed and return ducts pass through oblong slots provided in the bearings, the oblong slots extending circumferentially over a predetermined arc length so as to permit rotational displacement of the connectors of the feed and return ducts in said slots during pivoting of the spout and trunnions.

Each trunnion may be directly attached for rotation by its end to the output shaft of a reduction gear located on the horizontal pivot axis of the trunnions. The reduction gear may be an epicyclic reduction gear which drives the trunnions directly. The trunnions are then directly attached to the output shafts of the epicyclic reduction gears.

It will be understood that the previously mentioned bearings, through which the trunnions pass coaxially, do not necessarily, in the spirit of the invention, function as a direct support and rotational guide for the trunnions. This is because, since the trunnions are directly rotatably attached to the output shaft of the reduction gear, the trunnions may be rotationally guided and supported by the output shaft of the reduction gear itself, said output shaft therefore being guided in a crankcase of the reduction gear, which crankcase is fixed on an outer end of said bearings. In this case, radial play is preferably provided between the trunnions and bearings, and a gasket is arranged between the trunnion and the bearing, axially located between the end of the bearing which opens into the interior of the shell and the slots through which the flexible duct connectors pass.

The reduction gears likewise acting as a support for the trunnions could also be mounted fixedly relative to the shell by any appropriate means, without requiring bearings such as those mentioned above, merely by sealing means between the trunnions and the shell where the trunnions pass through the wall of said shell.

Still more preferably, the flexible ducts are connected to the trunnions at substantially diametrically opposed points.

According to another complementary arrangement, the output shaft of the reduction gear penetrates into a bore of the trunnion, where it is attached rotatably, and the internal cooling channels extend into the trunnion, between the connectors of the feed and return ducts, between the bore and the outer surface of the trunnion. Preferably, the internal cooling channels also extend between the bottom of the bore and the end of the trunnion bearing the spout. These arrangements in particular make it possible to provide effective cooling of the trunnion and prevent excessive transmission of heat from the spout towards the driving reduction gear via the trunnions.

BRIEF DESCRIPTION OF THE DRAWINGS

Other details and features of the invention will emerge from the following detailed description of an embodiment, provided by way of illustration with reference to the appended drawings, in which.

DETAILED DESCRIPTION OF THE DRAWINGS

Figure 1:
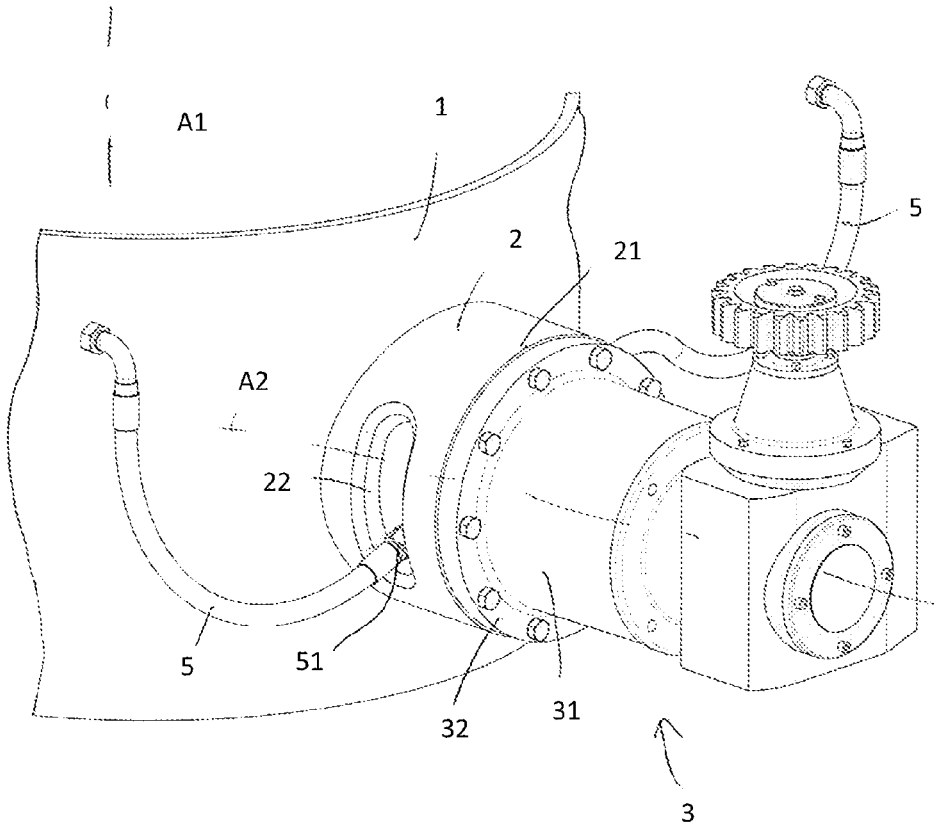
FIG. 1: is a perspective view of one of the two devices for supporting and pivotably driving the distribution spout of a blast furnace.

The drawing of FIG. 1 shows the shell 1 of the blast furnace charging device, rotatable about a vertical axis A1 of the blast furnace, and to which is attached a bearing 2 having on the end thereof a reduction gear 3 for pivotably driving the spout, not shown, about a horizontal axis A2. The reduction gear 3 comprises a crankcase 31 fixed to the outer end 21 of the bearing 2 by a flange 32.

Figure 2:
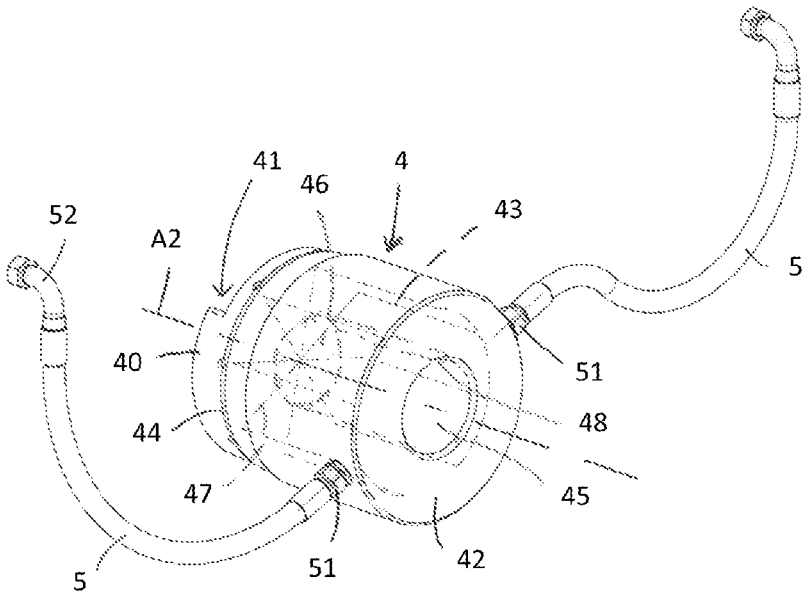
FIG. 2: is a perspective view of just the trunnion showing its connection means with an output shaft of a rotational drive reduction gear together with its internal cooling circuits and the water feed hoses.

The trunnion 4 for supporting the spout, shown in FIG. 2, comprises towards the inner end 40 thereof, oriented towards the axis A1, a receptacle 41 provided to receive supporting lugs of the spout, which are held rigidly therein in a manner known per se. The other end of the trunnion 42 is connected rigidly to an output shaft of the reduction gear 3, which output shaft is supported and guided rotatably in the crankcase 31. To this end, the trunnion comprises a blind bore 45 of a diameter suitable for receiving the end of the output shaft of the reduction gear without radial play, said shaft and the trunnion being connected rotatably for example by a key, which has a groove 48 provided in the bore 45.

The trunnion 4 is located in the bearing 2 but, as already mentioned, the trunnion is actually supported and guided rotationally by rotational guidance of the reduction gear output shaft in the crankcase 31. Consequently, the trunnion does not need to be supported and guided in the bearing 2, and radial play, for example of the order of 1 mm, is provided between the trunnion 4 and the bore of the bearing 2 through which said trunnion passes.

Oblong slots 22 are formed, in substantially diametrically opposed positions, in the wall of the bearing 2 between the shell 1 and the outer end 21 of the bearing 2. Cooling water feed hoses 5 are connected, at substantially diametrically opposed positions, to the trunnion, by connectors 51 screwed onto the trunnion, providing a leakproof connection between the hoses 5 and the internal cooling channels 43, 47 of the trunnion, represented by the dashed lines 43. The internal cooling channels are extended in the trunnion between the connectors 51 by channel portions 43 which extend longitudinally and/or in an arc of a circle between the bore 45 and the outer surface of the trunnion. Furthermore, a proportion 47 of these channels extends, for example radially, between the bottom 46 of the bore 45 and the inner end 40 of the trunnion. Circulation of cooling liquid in the trunnion thus provides effective cooling which prevents the transmission of heat from the spout towards the reduction gear 3.

The opposite ends 52 of the hoses are connected to the stationary cooling circuit, not shown, accommodated in the chamber surrounding the shell 1 and revolving with said shell. The connectors 51 pass through the slots 22, which extend over a length of arc which is sufficient to permit free displacement of the connectors 51 during pivoting of the trunnion and hence of the spout. This length of arc will therefore be at least equal to the value of the spout's maximum pivoting angle in service plus the length necessary to take account of the space occupied by the connectors 51. The corresponding range of rotation is typically 30 to 50 degrees, preferably 45 degrees.

Because of the play provided between the trunnion 4 and the bearing 2, leaks of the gas present in the blast furnace shaft could occur via this space and via the slots 22. To ensure tightness, a gasket, for example a braided gasket, is placed between the trunnion and the bearing, for example in a groove 44 provided for this purpose in the trunnion, said gasket being axially located between the inner end of the bearing 2 and the slots 22 cut in the bearing wall.

The invention claimed is:

1. A device for cooling the supporting trunnions of a distribution spout of a charging installation of a shaft furnace the distribution spout being mounted pivotably about a horizontal axis on a shell coaxial with the furnace and the distribution spout being attached to the trunnions driven in rotation by drive means, the trunnions comprising internal cooling channels, wherein the cooling device comprises feed and return ducts for the cooling water circulating in the internal cooling channels, the feed and return ducts being connected to the trunnions by connectors fixed to the cylindrical surface of the trunnions, and the feed and return ducts are configured such that the connectors are rotational displaced about the pivot axis of the distribution spout during pivoting of the distribution spout, wherein the trunnions are mounted revolvably inside bearings integral with the shell and the feed and return ducts pass through oblong slots provided in the bearings, the oblong slots extending circumferentially over a predetermined arc length such that the connectors are rotationally displaced in said slots during pivoting of the distribution spout.

2. The device according to claim 1, wherein each trunnion has an end and is directly attached for rotation by the end to the output shaft of a reduction gear located on the horizontal pivot axis of the trunnions.

3. The device according to claim 2, wherein the trunnions are rotationally guided and supported by the output shaft of the reduction gear which is guided in a crankcase of the reduction gear.

4. The device according to claim 3, wherein the crankcase of the reduction gear is fixed on an outer end of the bearings.

5. The device according to claim 3, wherein there is radial play between the trunnions and the bearings.

6. The device according to claim 5, wherein a gasket is arranged between the trunnion and the bearing, the gasket being axially located between the end of the bearing which opens into the interior of the shell and the slots.

7. The device according to claim 1, wherein the feed and return ducts are flexible ducts connected directly to the trunnions by screwed connectors.

8. The device according to claim 1, wherein the feed and return ducts are connected to the trunnions at substantially diametrically opposed points.

9. The device according to claim 1, wherein the shell is rotatable about the vertical axis of the furnace and the feed and return ducts are connected to a cooling circuit which is stationary relative to the shell, accommodated in the chamber surrounding the shell and revolving with said shell.

10. The device according to claim 2, wherein the output shaft of the reduction gear penetrates into a bore of the trunnion and is attached rotatably, and the internal cooling channels extend into the trunnion, between the connectors of the feed and return ducts, between the bore and the outer surface of the trunnion.

11. The device according to claim 10, wherein the internal cooling channels extend between the bottom of the bore and an opposite end of the trunnion located opposite from the end attached to the output shaft of the reduction gear.

* * * * *